United States Patent [19]

Sarcia

[11] 4,294,077

[45] Oct. 13, 1981

[54] CRYOGENIC REFRIGERATOR WITH DUAL CONTROL VALVES

[75] Inventor: Domenico S. Sarcia, Carlisle, Mass.

[73] Assignee: Oerlikon-Buhrle U.S.A. Inc., New York, N.Y.

[21] Appl. No.: 89,271

[22] Filed: Oct. 29, 1979

[51] Int. Cl.[3] ..... F25B 9/00

[52] U.S. Cl. ..... 62/6; 137/625.37

[58] Field of Search ..... 62/6; 137/625.34, 625.35, 137/625.37, 625.38

[56] References Cited

U.S. PATENT DOCUMENTS

| | | | |
|---|---|---|---|
| 2,906,101 | 9/1959 | McMahon et al. | 62/6 |
| 2,966,035 | 12/1960 | Gifford | 62/6 |
| 3,119,237 | 1/1964 | Gifford | 62/6 |
| 3,188,821 | 6/1965 | Chellis | 62/6 |
| 3,218,815 | 11/1965 | Chellis et al. | 62/6 |
| 3,421,331 | 1/1969 | Webb | 62/6 |
| 3,600,903 | 8/1971 | Chellis | 62/6 |
| 3,609,982 | 10/1971 | O'Neil et al. | 62/6 |
| 3,620,029 | 11/1971 | Longsworth | 62/6 |
| 3,733,837 | 5/1973 | Lobb | 62/6 |
| 3,788,088 | 1/1974 | Dehne | 62/6 |
| 3,853,146 | 12/1974 | Blair | 137/625.37 |
| 4,108,210 | 8/1978 | Luthe et al. | 137/625.37 |

*Primary Examiner*—Ronald C. Capossela
*Attorney, Agent, or Firm*—Schiller & Pandiscio

[57] ABSTRACT

A cryogenic cooler is disclosed which features a displacer and refrigerant flow control means comprising a first slide valve moveable by the displacer means and a second reversible valve operable separately from the first slide valve.

35 Claims, 10 Drawing Figures

CRYOGENIC REFRIGERATOR WITH DUAL CONTROL VALVES

This invention relates to cryogenic refrigeration and more specifically to improvements in the methods and equipments employed for producing refrigeration at relatively low temperatures (110° K.–14° K.).

BACKGROUND OF THE INVENTION

A number of unique refrigeration cycles and apparatus have been developed to satisfy the increasing demand for highly reliable, long-lasting cryogenic refrigerators for use in such diverse fields as electronic communications systems, missile tracking systems, super conducting circuitry, high field strength magnets, and medical and biology laboratories for preparation of tissue samples and freezing of solutions. These refrigeration cycles and apparatus, all based upon the controlled cycling of an expansible fluid with suitable heat exchange to obtain refrigeration, are exemplified by U.S. Pat. Nos. 2,906,101, 2,966,034, 2,966,035, 3,045,436, 3,115,015, 3,115,016, 3,119,237, 3,148,512, 3,188,819, 3,188,820, 3,188,821, 3,218,815, 3,333,433, 3,274,786, 3,321,926, 3,625,015, 3,733,837, 3,884,259, 4,078,389, and 4,118,943, and the prior art cited in the foregoing patents.

The present invention is directed at refrigeration systems which employ a working volume defined by a vessel having a displacer therein with a regenerator coupled between opposite ends of the vessel so that when the displacer is moved toward one end of the vessel, refrigerant fluid therein is driven through the regenerator to the opposite end of the vessel. Such systems may take various forms and employ various cycles, including the well known Gifford-McMahon, Taylor, Solvay and Split Stirling cycles. These refrigeration cycles and apparatus require valves or pistons for controlling the flow and movement of working fluid and the movement of the displacer means. The fluid flow and the displacer movement must be controlled continuously and accurately so that the system can operate according to a predetermined timing sequence as required by the particular refrigeration cycle for which the system is designed. Although a fixed timing sequence is the usual objective, it also is desirable to be able to alter the sequence in certain respects, e.g., the time over which high pressure fluid is introduced to the vessel or the time period during which expansion and cooling are achieved.

Heretofore the valving of cryogenic equipment of the type described has taken various forms, but inevitably the valving or the resulting refrigerator has suffered from one or more of the following limitations: complexity of construction, relatively high cost of manufacture, difficulty of modification as to timing sequence, relatively short operating life, poor reliability, difficulty of adjustment after assembly, and small range of refrigeration capacities. Additional specific problems that have plagued some prior cryogenic equipment have been disintegration of lead shot in the regenerator section due to the "slamming" or "banging" of the displacer on its mechanical stops each time it undergoes direction reversal, excessive size of the valving (or of the refrigerator because of the valving construction and/or location), the criticality or short life of seals between certain moving parts, reduced efficiency due to excessive work input or work absorption (e.g. high friction losses), and inability to operate at the low reciprocating speeds that are preferred for such apparatus. Added cost and performance limitations are presented by those devices where the diplacer movement is produced by mechanical means such as cams, eccentrics, etc.

OBJECTS AND SUMMARY OF THE INVENTION

It is therefore the primary object of this invention to provide a cryogenic apparatus characterized by a valve mechanism which not only is relatively simple and inexpensive to manufacture, but also allows the apparatus to be made in different sizes and makes possible an improved refrigeration cycle.

It is another object to provide cryogenic apparatus of the character described in which the valving mechanism may be easily removed for inspection and possible replacement.

Still another object of the invention is to provide an improved cryogenic refrigerator which is arranged and operated so that the direction of gas flow (injecting or exhausting) is reversed only when the displacer is substantially at the end of its upward or downward stroke, thereby assuring maximum gas volume transfer through the regenerator and consequently better refrigeration efficiency.

Still a further object of the invention is to provide a cryogenic refrigerator with a flow control slide valve which is designed to assure movement of the displacer with a consequent displacement of fluid in accordance with a predetermined refrigeration cycle.

Still another object of the invention is to provide a cryogenic apparatus having a fluid flow control valving which can be operated according to a selected variable timing sequence, with the valving comprising a first valve with a reciprocal valve member mechanically coupled to the displacer and a second valve located externally of the refrigeration apparatus.

The apparatus of this invention comprises cylinder means, displacer means movable within the cylinder means, first and second chambers the volumes of which are modified by the movement of the displacer means, conduit means connecting the first and second chambers and thermal storage means associated with the conduit means, and refrigerant flow control valve means for injecting high pressure fluid to and removing low pressure fluid from the first chamber with the pressure differential across the displacer means being varied cyclically so as to impart a predetermined motion to the displacer which consists of four steps in sequence as follows: dwelling in an uppermost position, moving downwardly, dwelling in a lowermost position, and moving upwardly. The valve means comprises a slide valve having a reciprocable valve member, with passageways for conducting fluid to and from the first chamber according to the position of the valve member. The valve member is operated so that high pressure fluid enters the first chamber and the conduit during two consecutive steps of the displacer motion and low pressure fluid is exhausted from the first chamber during the other two steps of the displacer motion. The reciprocable valve member is operated solely by the displacer means as the latter approaches its uppermost and lowermost positions. An auxiliary reversible valve is employed which cooperates with the slide valve to vary the pressure differential across the displacer, so that the displacer movement is controlled by the slide and auxiliary valves. The refrigeration equipment may consist of a single refrigeration stage or two or more stages connected in series in the manner disclosed by U.S. Pat. Nos. 3,188,818 and 3,218,815. Additionally the system may include auxiliary refrigeration stages employing one or more Joule-Thomson heat exchangers and expansion valves as disclosed by U.S. Pat. No. 3,415,077.

BRIEF DESCRIPTION OF THE DRAWINGS

Other features and many of the attendant advantages of the invention are described or rendered obvious by the following description and the accompanying drawings in which the same reference characters are used to refer to the same parts throughout the different views. The drawings are not necessarily to scale, emphasis instead being placed upon illustrating principles of the invention in a clear manner.

DESCRIPTION OF THE SEVERAL EMBODIMENTS OF THE INVENTION

In the following detailed description of the several embodiments of the invention, reference will be made from time to time to upper and lower sections. The terms "upper" and "lower" are used in a relative sense and it is to be understood that the refrigeration apparatus may be oriented in any manner. Hence, the terms "upper" and "lower" are employed in this description only to correspond to the orientation illustrated in the figures. Also, although helium gas is the preferred working fluid, it is to be understood that the present invention may be practiced with other gases according to the refrigeration temperatures that may be desired, including but not limited to, air and nitrogen.

Figure 1:
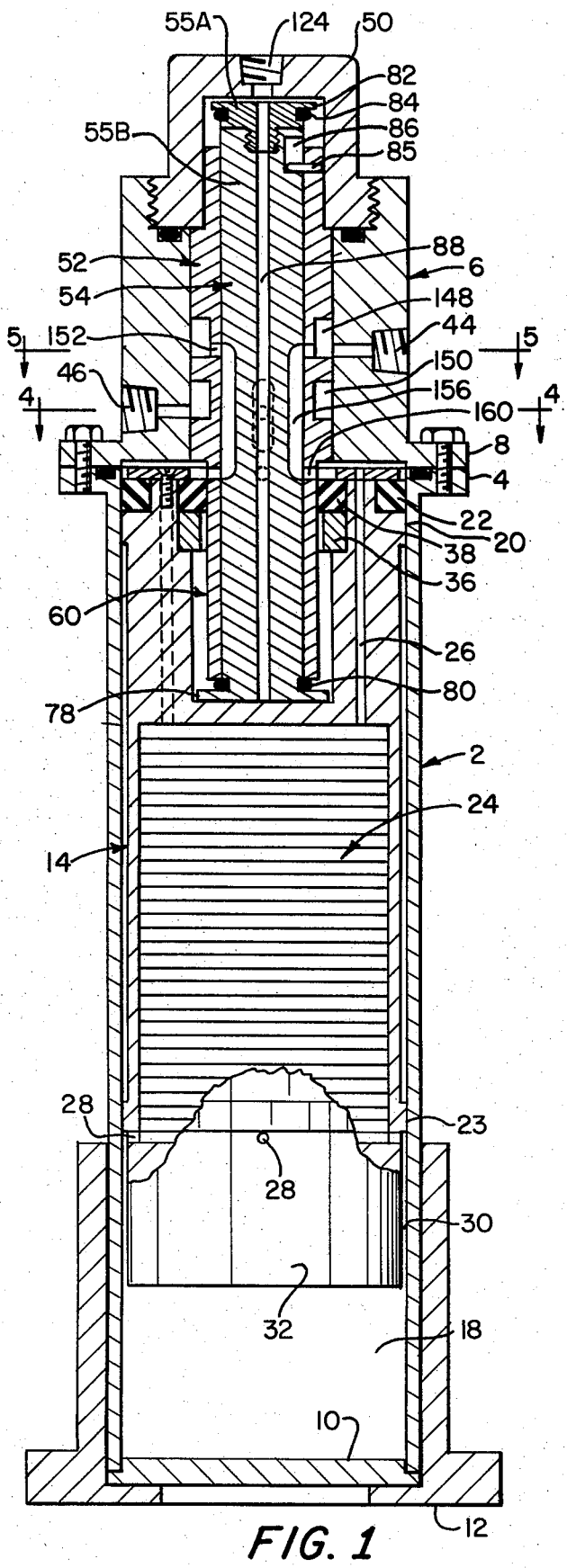
FIG. 1 is an enlarged, partially sectional view, of one embodiment of the invention constituting a Gifford-McMahon cycle cryogenic refrigerator, showing the displacer and in a first limit position.
Figure 2:
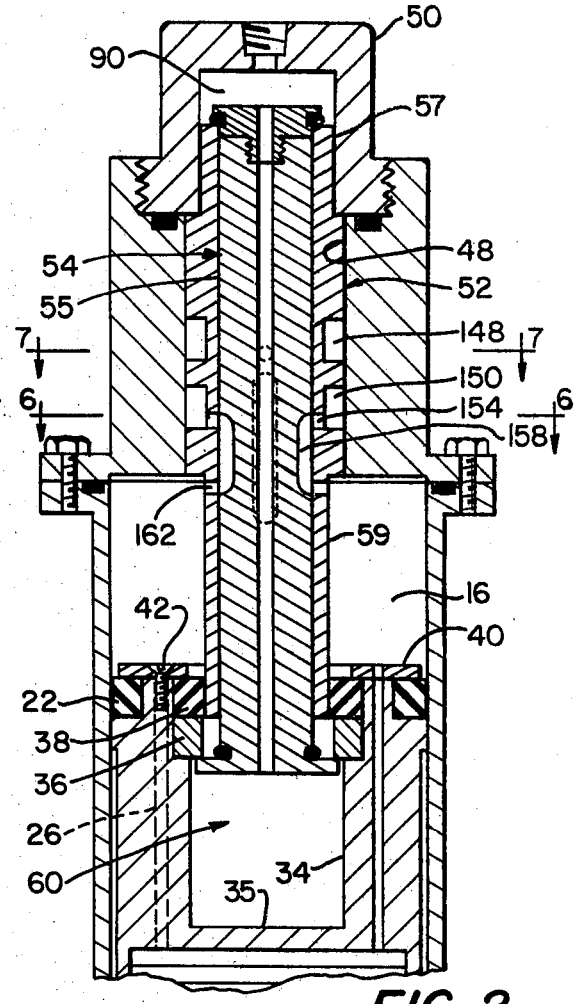
FIG. 2 is a view similar to FIG. 1 illustrating the displacer in a second limit position.
Figure 3:
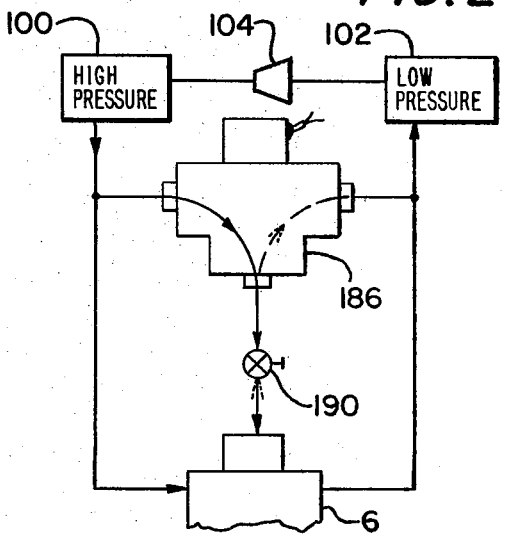
FIG. 3 schematically illustrates the external valving connections for the device of FIGS. 1 and 2.
Figure 4:
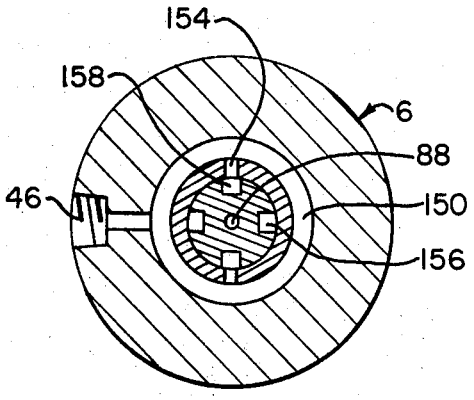
FIGS. 4 and 5 are cross-sectional views taken along the lines 4—4 and 5—5 respectively of FIG. 1.
Figure 6:
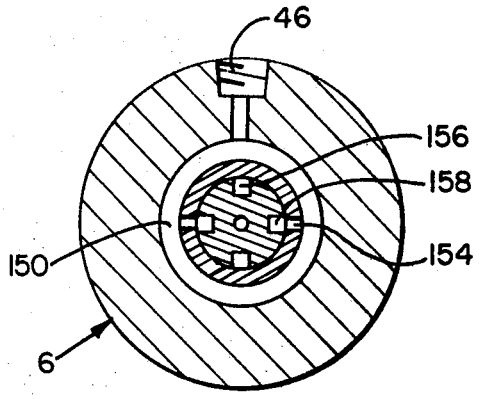
FIGS. 6 and 7 are cross-sectional views of the device shown in FIG. 2 taken along the lines 6—6 and 7—7 of FIG. 2.
Figure 5:
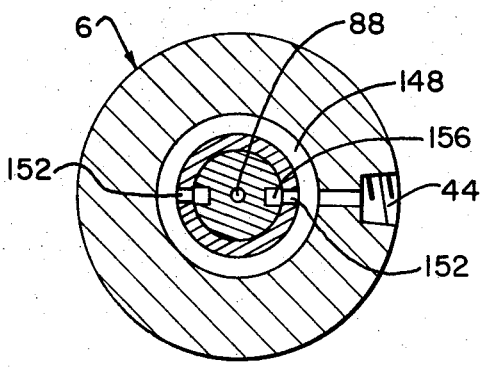
Figure 7:
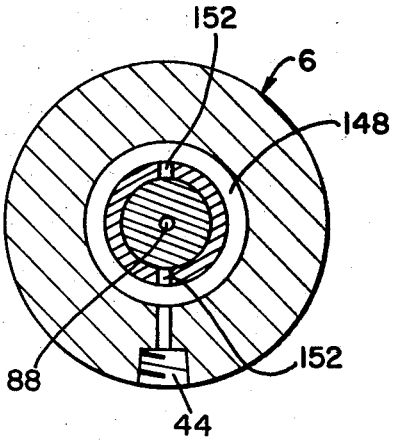

Referring now to FIGS. 1–3, the illustrated refrigeration apparatus is designed to operate in accordance with the Gifford-McMahon refrigeration cycle. The refrigerator is seen as comprising an external housing 2 having an upper flange 4 by means of which it is joined to a header 6. A bottom flange 8 on the header 6 is secured to the flange 4 by means of suitable screw fasteners 9. The refrigerator housing is closed on its lower colder end by a relatively thick end plate 10. If desired, a heat station in the form of a flanged tubular member 12 may be secured to the lower end of the housing wall. The end plate 10 and the heat station 12 are formed of a suitable metal, e.g., copper, which exhibits good thermal conductivity at the cryogenic temperatures produced by the system, with the end plate and the heat station being in heat exchange relationship with the cold fluid within the refrigerator so as to extract heat therefrom. The heat station may take other forms as, for example, coils surrounding the bottom end of the housing 2 or, as disclosed in U.S. Pat. No. 2,966,034, the refrigeration available at the lower end of the housing 2 may be used for the cooling of an infrared detector attached to the end wall 10.

A displacer 14 moves within the housing to define an upper warm chamber 16 of variable volume and a lower cold expansion chamber 18 of variable volume. A sliding fluid seal is formed between the upper section 20 of the displacer and the inner surface of the refrigerator housing 2 by a resilient sealing ring 22 which is mounted in a groove in the displacer. The lower section 23 of the displacer makes a sliding fit with the refrigerator housing but no effort need be made to provide a fluid seal between them.

Chambers 16 and 18 are in fluid communication through a fluid flow path which contains suitable heat-storage means. More specifically, the fluid path flow comprises a regenerator 24 which is located within the displacer 14 and one or more conduits or passageways 26 in the displacer which lead from the upper section of the regenerator to the chamber 16. The fluid flow path also includes pathways in the regenerator itself, a series of radial passages 28 formed in the lower displacer wall 32, and an annular passage 30 between the lower displacer wall and the inner surface of the housing 2. In accordance with known practice, the matrix of the regenerator may be formed of packed lead balls, fine metal screening, metal wire segments, or any other suitable heat high storage material affording low resistance pathways for gas flow. The exact construction of the regenerator may be varied substantially without affecting the mode of operation of the invention. Lower displacer wall 32 is formed of a metal having good thermal conductivity at the temperature produced in cold chamber 18.

The upper end of displacer 14 is formed with a coaxial bore 34 of circular cross section. The bore is enlarged at its upper end so as to form a shoulder against which is secured an annular metal ring 36. A resilient ring seal 38 is mounted in the upper end of the counterbore so as to provide a sliding fluid seal between the displacer and the confronting portion of the valve assembly hereinafter described. A plate 40 is secured to the upper end of the displacer by means of suitable fasteners 42. The plate 40 serves to assist in captivating seals 22 and 38.

The header 6 is provided with a first "LO" port 44 for exhausting low pressure fluid from the refrigerator and a second "HI" port 46 for use in introducing high pressure fluid. By way of example, the fluid is helium gas. The header has a cylindrical coaxial bore 48 with an enlarged threaded section at its top end which is closed off by a threaded cap member 50 having a port 124. The bore 48 accommodates the valving mechanism which consists of a valve casing 52 and a valve member 54. The casing 52 has an enlarged diameter section 55 which makes a close fit within the bore 48, a reduced diameter upper section 57 which makes a close fit in cap 50 and a reduced diameter bottom section 59 which extends into the axial bore 34 formed in the upper end of the displacer. The valve casing 52 is secured to the header 6 by suitable means, e.g. by a friction fit or a roll pin or a threaded connection, so that the valve casing is fixed with respect to the housing 2. The seal 38 engages the lower end 59 of the valve casing and forms a sliding fluid seal between the valve casing and the displacer, whereby a driving chamber 60 of variable volume is formed between the two members. In this device, chamber 60 is the "driving chamber", while chambers 16 and 18 are the "warm" and "cold" chambers respectively.

The valve member 54 is sized to make a snug sliding fit within valve casing 52. Valve member 54 is provided with a peripheral flange 78 at its lower end which is sized so as to make a sliding fit with the displacer in the bore 34 and to intercept the ring 36 when the displacer is moved downwardly relative to valve casing 52 (FIG. 2). An O-ring 80 is mounted in a groove in the valve member against flange 78 in position to engage the lower end of valve casing 52 and thereby act as a snubber when the valve member moves upwardly in the valve casing. The upper end of valve member 54 is provided with a second peripheral flange 82 which acts as a shoulder for another O-ring 84 mounted in a groove formed in the valve member. O-ring 84 is arranged so that it will intercept the upper end of valve casing 52 and thereby act as a snubber for the valve member. The valve member is held against rotation by means of a pin 85 which is secured in a hole in valve casing 52 and extends into a vertically elongate narrow slot 86 in the valve member. The slot 86 and the pin 85 are sized so as to permit the valve member to move axially far enough for the O-rings 80 and 84 to engage the corresponding ends of the valve casing and thereby limit the travel of the valve member 54. However, if desired, the O-rings 80 and 84 may be omitted and the limit of travel of the valve member may be determined by engagement of the flanges 78 and 82 with the ends of the valve casing (provided the flanges are appropriately arranged to permit the valve member to function in the manner hereinafter described), or by engagement of pin 85 with the upper and lower ends of slot 86. To facilitate assembly and disassembly, valve member 54 is made in two parts 55A and 55B which are releasably secured together e.g., by a threaded connection as shown. The parts 55A and 55B may be locked to one another by suitable means, e.g. LOCTITE ®.

Still referring to FIGS. 1–3, valve member 54 has a center passageway 88 which is open at both ends, i.e., so that it communicates with the chamber 60 and also with the chamber 90 formed between the upper end of the valve member, the upper end of the valve casing, and the cap 50. The valve casing 52 has two peripheral grooves 148 and 150 which connect with ports 44 and 46 respectively and serve as manifold chambers. Valve casing 52 is provided with a pair of diametrically opposed ports 152 (FIG. 1) intersecting groove 148 and a second pair of like ports 154 (FIG. 2) intersecting groove 150. Ports 154 are displaced ninety degrees from ports 152. Valve member 54 also is provided with a pair of narrow relatively long, diametrically opposed recesses 56 (FIG. 1) which have a length which is just sufficient to allow their upper ends to register exactly with ports 152 when their bottom ends are in exact registration with a pair of diametrically opposed ports 160 that are formed in valve casing 52 and are located just below the header so as to communicate with chamber 16. Valve member 54 also has a second pair of narrow relatively short, diametrically opposed recesses 158 (FIG. 2) which have a length just sufficient to allow their upper ends to register exactly with ports 154 when their lower ends are in exact registration with a pair of diametrically opposed ports 162 formed in valve casing 52 at the same level as but displaced ninety degrees from ports 160. The recesses 156 and 158 are arranged so that the ends of recesses 158 are blocked by the valve casing and recesses 156 are in complete registration with ports 152 and 160 when the slide valve member is in its upper limit position (FIG. 1); similarly the ends of recesses 156 are blocked by casing 52 and recesses 158 are in complete registration with ports 154 and 162 when the slide valve member is in its lower limit position (FIG. 2). The foregoing ports and recesses also are arranged so that the valve has an intermediate transition point where fluid flow between ports 162 and 46 and between ports 160 and 44 is terminated. This transition point occurs when the upper edges of recess 156 are even with the lower edges of ports 152 and the lower edges of recesses 158 are even with the upper edges of ports 162. This transition position is effectively the point where the valve is between states. Because of its capability of assuming this transition position, the valve may be looked upon as a three-state valve, i.e. capable of closing off ports 160 and 162 alternatively or simultaneously. In practice, however, when the valve is in its transition position some leakage of fluid may tend to occur between (a) passages 160 and 152 and (b) passages 162 and 154 due to clearances required to allow the member 54 to slide in casing 52 and also possibly due to imperfect formation and/or location of the various ports and passageways in the slide valve.

In the usual installation, the refrigerator of FIGS. 1–3 will have its port 44 connected to a reservoir or source of low pressure fluid 102 and its port 46 connected to a reservoir or source of high pressure fluid 100. It will, of course, be understood that the lower pressure fluid may exhaust to the atmosphere (open cycle) or may be returned to the system (closed cycle) by way of suitable conduits which lead first into a compressor 104 and then into the high pressure reservoir 100, in the manner illustrated in FIG. 1 of U.S. Pat. No. 2,966,035.

The device of FIGS. 1–7 also includes an external pilot in the form of a three-way solenoid valve 186. Two of the ports of valve 186 are connected to the HI and LO pressure sources and the third port is connected to port 124 via a manually adjustable flow rate control valve 190. Valve 186 is arranged so that it can selectively connect port 124 to one or the other of the two sources 100 and 102, according to whether its solenoid is energized or deenergized. Hence port 124 is always connected to one of the two sources. Valve 190 may be a needle-type valve.

Operation of the device of FIGS. 1–7 involves connecting the solenoid 192 of valve 186 to a suitable reversible d.c. voltage source, preferably a voltage source that produces a voltage signal which varies between 0 and a positive level at a selected frequency, e.g. a series of square or rectangular pulses occurring at a frequency of 3–12 Hz.

The cycle of operation of the device of FIGS. 1–7 will now be described. Assume that (a) displacer 14 is moving up and is short of its TDC position with its surface 35 just touching the lower end of slide valve member 54, with the latter in its bottom limit position (FIG. 2) so that high pressure valve ports 162 are open to HI port 46; and (b) solenoid valve 186 is set so that port 124 is connected to LO pressure source 102. At this point the fluid pressure and temperature conditions in the refrigerator are as follows: chamber 16—high pressure and room temperature; chamber 18—high pressure and low temperature; chambers 60 and 90—low pressure and room temperature. The pressure differential across the displacer keeps it moving up so that it pushes the slide valve to its upper limit position (FIG. 1), thereby closing high pressure ports 162 and opening the low pressure ports 160 to LO port 144. Now chambers 16 and 18 are exhausting and the pressure in those chambers becomes equal to that in chamber 60. So the displacer stops near its TDC position. At this point the solenoid valve is caused to change states, connecting the HI source 100 to port 124 so as to cause an increase in the pressure in chamber 60. The pressures in chambers 16 and 18 are still low, so the displacer moves down as a consequence of the increasing pressure in chamber 60. The downwardly moving displacer intercepts the slide valve and pulls it down far enough to close off the low pressure ports 160 and open the high pressure ports 162. Now the pressure in chambers 16 and 18 go from low to high and equalize with the high pressure in chamber 60, whereupon the displacer stops in its BDC position. Next the solenoid valve closes its high pressure port and opens its low pressure port, thereby causing the pressure in chamber 60 to go from high to low. As a consequence the differential pressure on the displacer causes it to move up and again move the slide valve member to its upper limit position; this results in the low pressure ports 160 opening and the high pressure ports 162 closing. The pressure in chambers 16 and 18 now equalizes again with the pressure in chamber 60, causing the displacer to stop in its TDC position. At this point, the solenoid is again actuated so as to open its HI port to port 124, whereupon the cycle continues and repeats itself in the manner described above. When the slide valve is in its upper limit position and the displacer is in its TDC position, cold high pressure gas in chamber 18 will exhaust through the regenerator and as it does it gets heated up by the regenerator matrix. Then when the displacer starts to move down it displaces more gas from chamber 18 to chamber 16. However, as the displacer starts down, valve member 54 will remain in its top limit position. Thus, as the displacer moves down the slide valve will continue to exhaust low pressure gas from chamber 16, and the regenerator cools down further as it gives up heat to the remainder of the cold gas displaced from chamber 18. The cold gas flowing out through the regenerator expands on heating, thus cooling the regenerator further.

Figure 8:
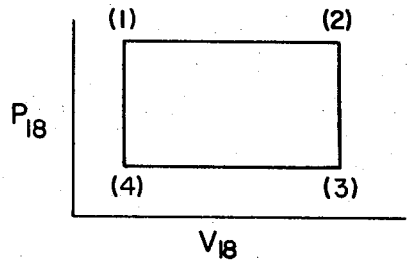
FIG. 8 is a pressure-volume diagram characteristic of the device of FIGS. 1–7.

Not only does the foregoing system of FIGS. 1–7 provide a dependable and precisely controllable mode of operation, but it also is characterized by an essentially square or rectangular pressure volume (PV) diagram as shown in FIG. 8, where P and V are the pressures and volume of chamber 18. The excursion from (1) to (2) represents upward movement of the displacer, the excursion from (2) to (3) represents the exhausting (cooling by expansion) which occurs while the displacer is at TDC, the excursion from (3) to (4) represents downward movement of the displacer, and the excursion from (4) to (1) represents the compression which occurs due to continued influx of high pressure, room temperature gas into chambers 16 and 18 while the displacer is at BDC.

Figures 9, 10:
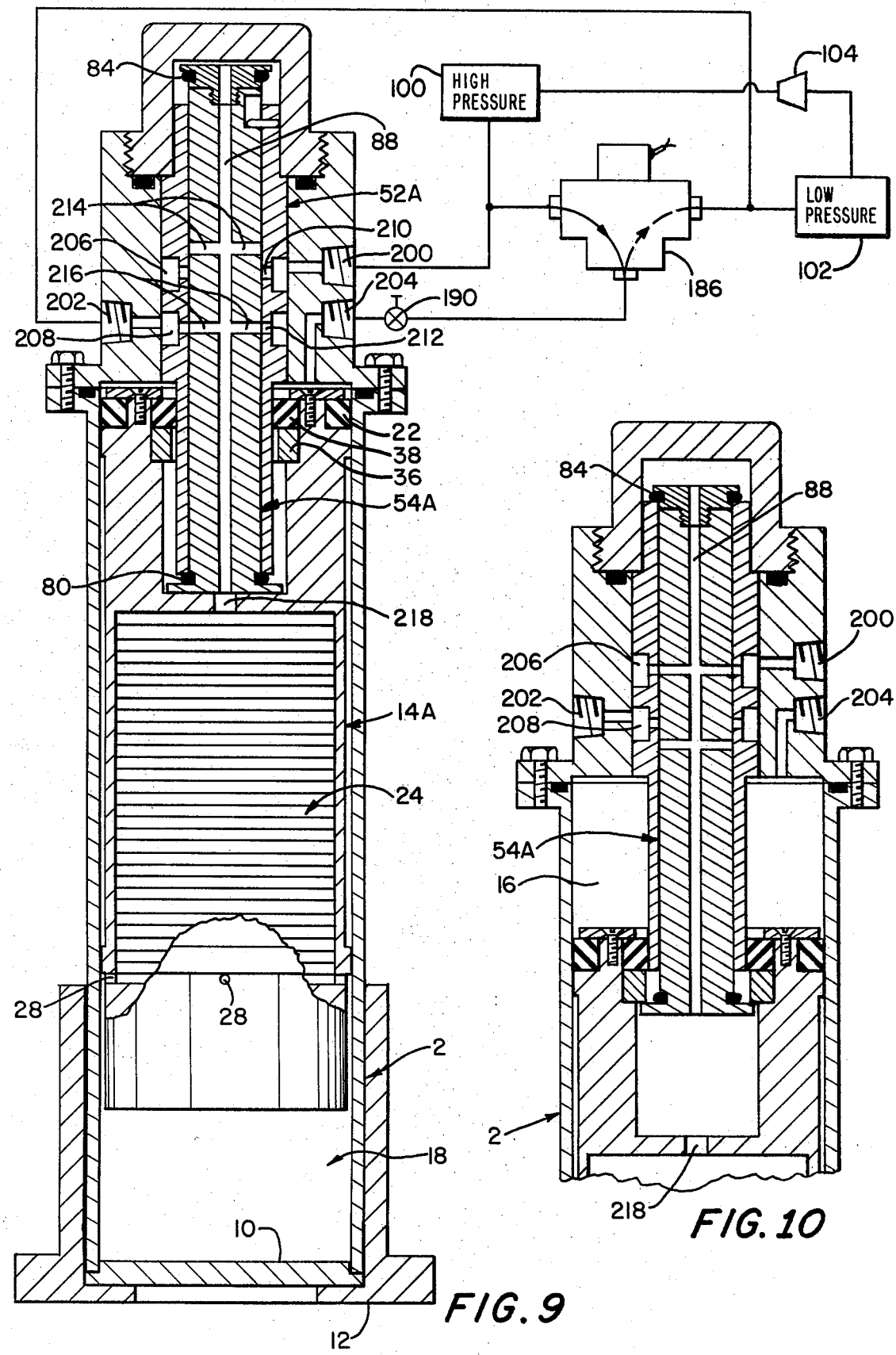
FIGS. 9 and 10 are sectional views showing two different operating positions of a preferred embodiment of the invention.

FIGS. 9 and 10 show a preferred embodiment of the invention. Except as otherwise noted hereafter, the device of FIGS. 9 and 10 is the same as the device described above. In this case the header 6A comprises three ports 200, 202 and 204, with the latter port leading directly to chamber 16 while the two other ports communicate with a slide valve comprising a valve casing 52A and a slide valve member 54A. Casing 52A has two annular grooves 206 and 208 which communicate with ports 200 and 202 respectively, plus two pairs of diametrically opposed ports 210 and 212 which intersect grooves 206 and 208 respectively. The slide valve member 54A has a central passage 88 plus two pairs of diametrically opposed, radially extending passages 214 and 216 that intersect passage 88. Passages 214 and 216 are disposed so that (a) when valve member 54A is in its upper limit position (FIG. 9) as determined by engagement of O-ring 80 with the lower end surface of casing 52A, the two passages 216 are aligned with the two ports 212 and passages 214 are blocked by the valve casing, (b) when the valve member is in its lower limit position (FIG. 10) as determined by engagement of O-ring 84 with the upper end of casing 52A, passages 214 are aligned with ports 210 and passages 216 are blocked by the valve casing; and (c) when the valve member is disposed with the upper edges of passages 216 even with lower edges of ports 212, the lower edge of passages 214 are even with the upper edges of ports 210.

Ports 200 and 202 are connected to the HI and LO pressure sources 100 and 102 respectively and also to two different ports of a three-way solenoid valve 186 as shown. Port 204 is connected by a manually adjustable flow control valve 190 to the third port of valve 186. Valve 186 connects port 204 to the HI or LO pressure source according to whether its solenoid is energized or deenergized.

The device of FIGS. 9 and 10 also differs from that of FIGS. 1–7 in that the displacer 14A does not have any conduits connecting the regenerator 24 with chamber 16. Instead it has a passageway 218 which leads from the regenerator into chamber 60, whereby gas can flow between chamber 18 and ports 200 and 202 via openings 28, regenerator 24, passageway 218, chamber 60 and the slide valve. Hence in this case chamber 16 is the driving chamber and chambers 60 and 18 are the warm and cold chambers respectively.

Operation of the device of FIGS. 9 and 10 is as follows: Assume that (a) solenoid valve 186 is set so that port 204 is connected to LO pressure source 102, (b) chambers 60 and 18 are at high pressures, and (c) the displacer is moving upwards. The displacer pushes slide valve member 54A upward to its upper limit position (FIG. 1), whereby its low pressure passages 216 are open to port 202. This allows the high pressure gas in chambers 60 and 18 to exhaust via passage 88. The pressure above the displacer is low so the displacer will become stationary due to no pressure differential across it. The solenoid valve now is caused to change states so that now port 204 is connected to HI pressure source 100, whereupon the chamber 16 receives high pressure gas which causes the displacer to move down again. The slide valve member is forced to its lower limit position by the displacer as the latter reaches its BDC position, whereupon high pressure gas enters chambers 60 and 18 and causes the displacer to stop since the pressure in chamber 16 is also high. Upward movement of the displacer is initiated by reversing the solenoid valve so that chamber 16 is connected to the LO pressure source 102. Thereafter the displacer forces the slide valve member to its upper limit position and the cycle is repeated in the manner just described. Although not shown it is to be understood that electrical control means are provided for periodically causing the solenoid of valve 186 to be energized and deenergized so as to control the operating cycle of the devices of this invention. Since the slide valve stroke is relatively short, e.g., 1/4 or less, and the valve 190 controls the rate of fluid flow to and from chamber 16, the devices can be made to operate at various speeds. In practice the solenoid valve can be controlled by various means operating at a fixed or variable frequency, e.g., a solid state controller embodying a variable frequency oscillator such as a multivibrator, or a cam or motor-driven commutator switch operating a power relay. The resulting refrigeration cycle is characterized by a rectangular P/V diagram similar to the one shown in FIG. 8. The device of FIGS. 9 and 10 has an advantage over the device of FIGS. 1–7 in that the effective area of the displacer responding to the pressure differential is greater since the area of the upper end of the displacer between valve casing 52A and the wall of cylinder 2 is greater than the area of the upper end of the displacer forming part of chamber 60.

All of the foregoing embodiments of the invention are capable of carrying out the Gifford-McMahon cycle and persons skilled in the art will appreciate that the invention is susceptible of other modifications made in contemplation of other known refrigeration cycles. The invention offers many advantages, including but not limited to the ability to control displacer speed, adaptability to different sizes and capacities, compatibility with existing cryogenic technology (e.g., use of conventional regenerators), the simplicity, ease of removal and reliability of the slide valves, the ability to scale up displacer size without having to proportionally increase the diameter or length of the slide valve, the relatively short slide valve stroke (which may be as little as $\frac{1}{8}$ inch), and the ability to eliminate or reduce banging of the displacer and slide valve. The O-rings 80 and 84 cushion the slide valve to reduce noise and also assist in properly locating the slide valve member at its two limit positions. A further advantage is that the slide valve operates at ambient temperature even while the lower end of cylinder 2 is at temperatures in the region of 110° K. to 14° K.

Of course, although not shown, it is to be understood that the foregoing systems could be made with two or more similar refrigeration stages in series as shown, for example, by U.S. Pat. Nos. 3,188,818 and 3,218,815, or with auxiliary refrigeration stages employing one or more Joule-Thomson heat exchangers and expansion valves as shown by U.S. Pat. No. 3,415,077, or with regenerators located outside of the displacer as shown by prior art herein referred to. Preferably but not necessarily, the ports 152, 154, 160, 162 are all round and of the same diameter, and the passages 156 and 158 have the same effective cross-sectional area, as do the ports 210 and 212 and the passageways 214 and 216. Other advantages and modifications will be obvious to persons skilled in the art.

What is claimed is:

1. In a cryogenic refrigerator in which a movable displacer means defines within an enclosure first and second chambers of variable volume, and in which a refrigeration fluid is circulated in a fluid flow path between said first chamber and said second chamber by the movement of said displacer means controlled through the introduction of high-pressure fluid and the discharge of low-pressure fluid, the improvement which comprises in combination:

valve support means connected to said enclosure;

a valve supported by said valve support means, said valve having a high-pressure inlet port, a low-pressure outlet port, and a bi-directionally movable valve member having first and second passages arranged so as to alternately connect said inlet and outlet ports to said first chamber according to the position of said valve member;

a third variable volume chamber defined in part by said displacer means; and means for transmitting a fluid between said third variable volume chamber and a selected high pressure source or a selected low pressure source independently of the mode of fluid flow determined by the connections made by said valve member between said inlet and outlet ports and said first chamber.

2. A refrigerator according to claim 1 wherein said valve member is movable bidirectionally by said displacer means and said displacer means is capable of limited movement independently of said valve member so as to permit transfer of a substantial amount of fluid in a given direction from one to the other of said first and second chambers as a result of displacement by said displacer means before causing said valve member to reverse the fluid flow connections between said inlet and outlet ports and said first chamber.

3. A refrigerator in accordance with claim 1 wherein said first chamber surrounds a portion of said valve.

4. A refrigerator in accordance with claim 1 wherein said displacer means is in telescoping relation with at least a portion of said valve.

5. A refrigerator in accordance with claim 1 wherein said valve comprises a valve casing surrounding said valve member, and further wherein said valve member protrudes from one end of said valve casing and is engageable with said displacer means.

6. A refrigerator according to claim 5 wherein said valve member and said displacer means are provided with (a) first and second mutually confronting means respectively for causing said valve member to be engaged and shifted by said displacer means as the displacer means moves in a first direction, and (b) third and fourth mutually confronting means respectively for causing said valve member to be engaged and shifted by said displacer means as the displacer means moves in a second opposite direction.

7. A refrigerator according to claim 6 wherein said valve member is shifted by said displacer means in the direction of movement of the displacer means.

8. A refrigerator in accordance with claim 1 wherein said enclosure comprises an elongate metal housing in which said displacer means is slidably disposed, and further wherein said valve includes a valve casing fixed to said housing.

9. A refrigerator in accordance with claim 8 having a header affixed to said housing and supporting said valve casing, said header including first and second passageways for connecting said inlet and outlet ports respectively to high pressure and low pressure reservoirs respectively.

10. A refrigerator according to claim 9 further including high pressure and low pressure reservoirs connected to said first and second passageways respectively, and a compressor connected for compressing fluid flowing from said low pressure reservoir and delivering the compressed fluid to the high pressure reservoir.

11. A refrigerator according to claim 1 having regenerator means for exchanging heat with the fluid transferred by the displacer means.

12. A refrigerator according to claim 11 wherein the regenerator means is embodied in the displacer means.

13. A refrigerator according to claim 1 wherein said valve member is slidably mounted for reciprocal motion in a valve casing, one end of said valve member protrudes into said third variable volume chamber, a fourth variable volume chamber is formed by means cooperating with the opposite end of the valve member and the valve casing, and the valve member includes a passageway for equalizing the pressure in said third and fourth variable volume chambers.

14. A refrigerator according to claim 1 wherein said means for transmitting fluid between said high and low pressure sources and said third variable volume chamber comprises an electrically controlled valve capable of being periodically switched from a first state to a second state and vice versa.

15. A refrigerator according to claim 1 wherein said valve includes a valve casing having first and second transfer ports, and said valve member is slidable in the valve casing and comprises first and second means for (a) connecting said inlet port to said first chamber via said first transfer port when the valve member is in a first position and (b) connecting said outlet port to said first chamber via said second transfer port when said valve member is in a second position.

16. A refrigerator according to claim 15 wherein said enclosure comprises a header and a housing connected at one end to said header, said header having passageways for connecting said inlet and outlet ports to high pressure and low pressure lines, and further wherein said valve casing is supported by said header, and said displacer means is disposed within said housing with said first and second chambers being formed by opposite ends of the displacer means and corresponding ends of the housing.

17. A refrigerator according to claim 16 wherein said valve casing and said displacer means are in telescoping relation with one another and said valve member is engaged by said displacer means at different positions of said displacer means and propelled thereby to one or the other of its first and second positions as the displacer moves in a first direction or a second opposite direction respectively.

18. A refrigerator according to claim 1 further including means for recovering refrigeration from the second chamber.

19. A cryogenic refrigerator comprising:

cylinder means, displacer means movable within the cylinder means according to a four step sequence wherein it (a) dwells in an uppermost position, (b) moves downwardly, (c) dwells in a lowermost position and (d) moves upwardly again;

first and second chambers the volumes of which are defined by movement of the displacer means, conduit means connecting said first and second chambers, thermal storage means associated with said conduit means, supply reservoir means for supplying high pressure fluid;

exhaust reservoir means for receiving low pressure fluid;

refrigerator regulating valve means associated with the supply and exhaust reservoir means for causing high pressure fluid to enter the first chamber and the conduit during the first-mentioned and second-mentioned steps of the displacer means motion and to exhaust low-pressure fluid during the third and fourth steps of the displacer means motion, said valve means comprising a valve casing fixed with respect to the cylinder means and a valve member slidable relative to the casing, the casing having inlet and outlet ports communicating with said supply reservoir means and said exhaust reservoir means respectively, said valve casing and valve member also having cooperating means for alternately connecting said first chamber to one of said inlet and outlet ports while simultaneously disconnecting it from the other of said inlet and outlet ports according to the movement of the valve member between two limit positions, and cooperating means on the displacer means and valve member for (a) causing the valve member to be in one of its limit positions and the displacer means to be in its uppermost position concurrently, and (b) causing the valve member to be in its other limit position and the displacer means to be in its lowermost position concurrently;

a third variable volume chamber defined at least in part by said displacer means; and auxiliary valve means operable independently of said refrigerator regulating valve means and adapted to alternately connect said third variable volume chamber to a source of high pressure fluid or a source of low pressure fluid.

20. A refrigerator according to claim 19 wherein said auxiliary valve means is a solenoid-controlled valve.

21. A refrigerator according to claim 19 wherein said auxiliary valve means is remote from said first-mentioned valve means.

22. In a cryogenic refrigerator in which (1) a reciprocable displacer means defines within an enclosure first and second chambers of variable volume, (2) fluid under pressure is delivered from said first chamber said second chamber with initial cooling, is subsequently expanded for further cooling, and is thereafter discharged from the refrigerator, and (3) said fluid is transferred through said refrigerator by the reciprocating movement of said displacer means controlled through the introduction of high-pressure fluid and the discharge of low-pressure fluid, the improvement comprising a fluidic driving means for the displacer means which comprises in combination:

a valve comprising a valve casing and a valve member, said valve casing being fixed with respect to said enclosure and having a high-pressure inlet port, a low-pressure outlet port, and a passageway means communicating with said first chamber, and said valve member being movable bidirectionally relative to said casing and having first and second passages arranged so as to alternately connect said inlet and outlet ports to said passageway means according to the position of said valve member;

a third chamber having a volume which varies with movement of the displacer means;

a passageway leading to said third chamber; and a second valve means for automatically connecting said third chamber to a high pressure fluid source when the displacer means is in a first position and to a low pressure fluid source when said displacer means is in a second position.

23. A refrigerator in accordance with claim 22 wherein said second valve means is a solenoid valve having first, second and third ports and a valve member for alternately connecting said first and second ports to said third port, said first and second ports being connected to high and low pressure fluid sources and said third port being connected to the said passageway that leads to said third chamber.

24. A refrigerator according to claim 22 wherein said enclosure comprises a cylinder in which said displacer means reciprocates and a header attached to one end of said cylinder, said casing being supported by said header and said third chamber being formed by said cylinder and said displacer means.

25. A refrigerator according to claim 22 wherein said passageway means comprises a third passage in said valve member connected to said first and second passages.

26. A refrigerator according to claim 22 wherein said passageway means comprises ports in said valve casing.

27. A cryogenic refrigerator comprising:

cylinder means, a reciprocable displacer means located within the cylinder means and cooperating therewith to define first and second chambers having volumes which vary with movement of the displacer means relative to the cylinder means, said displacer means being reciprocable within the cylinder means according to a four step sequence wherein it (a) reaches an uppermost position, (b) moves downwardly, (c) reaches a lowermost position and (d) moves upwardly again;

conduit means connecting said first and second chambers, thermal storage means associated with said conduit means, supply reservoir means for supplying high pressure refrigerant fluid;

exhaust reservoir means for receiving low pressure refrigerant fluid;

a header attached to one end of said cylinder means and having inlet and outlet passageways connected to said supply reservoir means and said exhaust reservoir means respectively;

refrigerator regulating valve means associated with the supply and exhaust reservoir means for causing high pressure refrigerant fluid to enter the first chamber and the conduit during the first-mentioned and second-mentioned steps of the displacer means motion and to exhaust low-pressure refrigerant fluid during the third and fourth steps of the displacer means motion, said valve means comprising a valve casing mounted to said header and a valve member slidable relative to the casing, the casing having inlet and outlet ports communicating with said inlet and outlet passageways respectively, said valve casing and valve member also having cooperating means for alternately connecting said first chamber to one of said inlet and outlet ports while simultaneously disconnecting it from the other of said inlet and outlet ports according to the movement of the valve member between two limit positions, and cooperating means on the displacer means and valve member for (a) causing the valve member to be in one of its limit positions and the displacer means to be in its uppermost position concurrently, and (b) causing the valve member to be in its other limit position and the displacer means to be in its lowermost position concurrently;

a third variable volume chamber defined at least in part by said displacer means; and auxiliary valve means operable independently of said refrigerator regulating valve means and adapted to alternately connect said third variable volume chamber to a source of high pressure fluid or a source of low pressure fluid.

28. A refrigerator according to claim 27 wherein said auxiliary valve means is a solenoid-controlled valve.

29. A refrigerator according to claim 27 wherein said auxiliary valve means is remote from said first-mentioned valve means.

30. A refrigerator according to claim 27 wherein said third variable volume chamber is defined in part by said refrigerator regulating valve means.

31. A cryogenic refrigerator comprising:

cylinder means;

displacer means movable within the cylinder means according to a four step sequence wherein it (a) dwells in an uppermost position, (b) moves downwardly, (c) dwells in a lowermost position and (d) moves upwardly again;

first and second variable chambers in said cylinder means defined in part by said displacer means;

a third variable volume chamber in said cylinder means defined in part by said displacer;

conduit means connecting said second and third chambers;

thermal storage means associated with said conduit means;

supply reservoir means for supplying high pressure fluid;

exhaust reservoir means for receiving low pressure fluid;

refrigerator regulating valve means associated with the supply and exhaust reservoir means for causing high pressure fluid to enter the third chamber and the conduit during the first-mentioned and second-mentioned steps of the displacer means motion and to exhaust low-pressure fluid from the third chamber during the third and fourth steps of the displacer means motion, said valve means comprising a valve casing fixed with respect to the cylinder means and a valve member slidable relative to the casing, the casing having inlet and outlet ports communicating with said supply reservoir means and said exhaust reservoir means respectively, said valve casing and valve member also having cooperating means for alternately connecting said third chamber to one of said inlet and outlet ports while simultaneously disconnecting it from the other of said inlet and outlet ports according to the movement of the valve member between two limit positions, and cooperating means on the displacer means and valve member for (a) causing the valve member to be in one of its limit positions and the displacer means to be in its uppermost position concurrently, and (b) causing the valve member to be in its other limit position and the displacer means to be in its lowermost position concurrently; and auxiliary valve means operable independently of said refrigerator regulating valve means and adapted to alternately connect said first variable volume chamber to a source of high pressure fluid or a source of low pressure fluid.

32. A refrigerator according to claim 31 wherein said auxiliary valve means is a solenoid-controlled valve.

33. A refrigerator according to claim 31 wherein said auxiliary valve means is remote from said first-mentioned valve means.

34. A refrigerator according to claim 31 wherein said first and second chambers are at opposite ends of said cylinder means, and said third chamber is defined in part by said slidable valve member.

35. A refrigerator according to claim 34 wherein said thermal storage means is disposed within said displacer.

* * * * *